US006241637B1

(12) United States Patent
Basyuk

(10) Patent No.: US 6,241,637 B1
(45) Date of Patent: Jun. 5, 2001

(54) HAND EXERCISE DEVICE

(76) Inventor: Simon Basyuk, 436 Millburn Ave., Millburn, NJ (US) 07041

( * ) Notice: Subject to any disclaimer, the term of this patent is extended or adjusted under 35 U.S.C. 154(b) by 0 days.

(21) Appl. No.: 09/329,695

(22) Filed: Jun. 10, 1999

Related U.S. Application Data

(60) Provisional application No. 60/089,943, filed on Jun. 19, 1998.

(51) Int. Cl.[7] ..... A63R 23/14; A63R 23/16

(52) U.S. Cl. ..... 482/44; 482/49

(58) Field of Search ..... 482/44, 45, 49, 482/50, 114, 131, 148, 106, 108, 46; 601/40; 401/6.8; 446/267, 369

(56) References Cited

U.S. PATENT DOCUMENTS 940,744 * 11/1909 Smith .
1,044,018 * 11/1912 Calvert .
4,538,806 * 9/1985 Wilkerson ..... 272/122
4,830,364 * 5/1989 Wexler ..... 272/93
5,533,949 * 7/1996 Hwang ..... 482/47

* cited by examiner

*Primary Examiner*—Justine R. Yu
(74) *Attorney, Agent, or Firm*—Lawrence G. Fridman

(57) ABSTRACT

A hand exercise device comprises a hollow housing with a plurality of apertures extending through its outer wall. Exercise rods extend from the interior of the housing and through the apertures. The rods may have an enlarged section with a cross dimension that is greater than a cross dimension of the apertures for retaining the rods in the housing. Filler material is located within the housing interior. The filler material comprises a plurality of solid particles in frictional engagement with the portion of each rod within the housing to thereby resist sliding movement of the rods when they are either pushed or pulled by a user. Several different embodiments of the hand exercise device are disclosed.

18 Claims, 11 Drawing Sheets

HAND EXERCISE DEVICE

CROSS REFERENCE TO RELATED APPLICATIONS

This application claims the benefit of U.S. Provisional Application No. 60/089,943 filed on Jun. 19, 1998.

BACKGROUND OF THE INVENTION

1. Field of the Invention

This invention relates to exercise devices, and more particularly to an exercise device for developing the muscles associated with the hand and fingers.

2. Description of the Related Art

In recent years, many individuals have focused attention on total body development through personally tailored diet and fitness programs. This is evident from the growth in fitness centers, retail sales of equipment for use at home and in physical fitness programs, and media attention to the growing public awareness of the need for proper diet and exercise and the benefits to be derived therefrom.

Today, fitness centers and retail stores are well-equipped with free weights and body building machines. They also generally include apparatus and other facilities for aerobic conditioning including stationary bicycles, stair steppers, and running machines. In addition, fitness centers are well known for specialized programs of fitness training.

Despite the wide range of equipment and programs, exercise devices for development of the hands, fingers and forearms have been largely ignored. It is notable that, despite the many expensive devices commonly found in fitness centers and retail stores, it is difficult to find equipment for increasing the strength and flexibility of the hands, fingers and forearms even though such development is important for properly utilizing the free weights and body building machines such as those commonly found in fitness centers. Even when provided, however, the development and implementation of exercise devices for the hands and fingers has lagged in comparison to other exercise devices.

One well known hand exerciser includes a pair of handles joined together at corresponding ends by a coil spring. Another well known hand exerciser consists of a simple rubber ball that is squeezed by the hand of a user.

SUMMARY OF THE INVENTION

The present invention provides an exercise device that is aesthetically pleasing, compact, and essentially self-contained. An exercise device according to the invention comprises a housing having at least one wall portion defining a hollow interior, at least one aperture extending through the wall portion, and at least one elongate rod having opposite ends and a center section located between the opposite ends. The center section of the at least one rod is normally located within the hollow interior and is adapted for slidable movement through the at least one aperture when the rod is pushed or pulled by a user. Filler material is located within the hollow interior. The filler material comprises a plurality of solid particles in frictional engagement with the elongate rod to thereby resist sliding movement of the rod through the at least one aperture.

In one embodiment, the housing is substantially of hollow spherical construction. The rod preferably includes an enlarged section positioned either at the center section of the rod or at one or both ends of the rod. The enlarged section has a cross dimension that is larger than a cross dimension of the aperture to thereby prevent separation of the rod from the housing.

In another embodiment, the housing includes a front end portion, a rear end portion spaced from the front end portion, and a continuous wall portion extend between, and connected to the front and rear end portions to thereby form the hollow interior. Preferably, first and second spaced apertures extend through each of the front and rear end portions with a first rod extending through the first apertures of the front and rear end portions and a second rod extending through the second apertures of the front and rear end portions. A piston head may be located within the hollow interior and connected between the first and second rods.

There are, of course, additional features of the invention that will be described hereinafter which will form the subject matter of the appended claims. Those skilled in the art will appreciate that the preferred embodiments may readily be used as a basis for designing other structures, methods and systems for carrying out the several purposes of the present invention. It is important, therefore, that the claims be regarded as including such equivalent constructions since they do not depart from the spirit and scope of the present invention. The foregoing and other features and advantages of the invention will be apparent from the following more particular description of preferred embodiments of the invention, as illustrated in the accompanying drawings.

BRIEF DESCRIPTION OF THE DRAWINGS

The preferred embodiments of the present invention will hereinafter be described in conjunction with the appended drawings, which are provided to illustrate and not to limit the invention in which.

DETAILED DESCRIPTION OF THE PREFERRED EMBODIMENT

Figure 1:
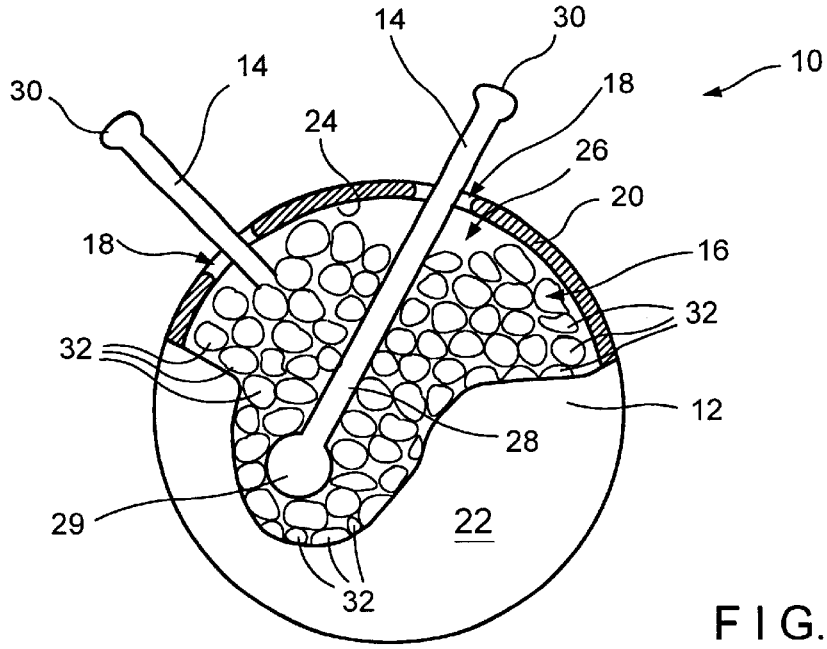
FIG. 1 is a front elevational view, in partial cross section, of a hand exercise device according to a first embodiment of the invention.
Figure 2:
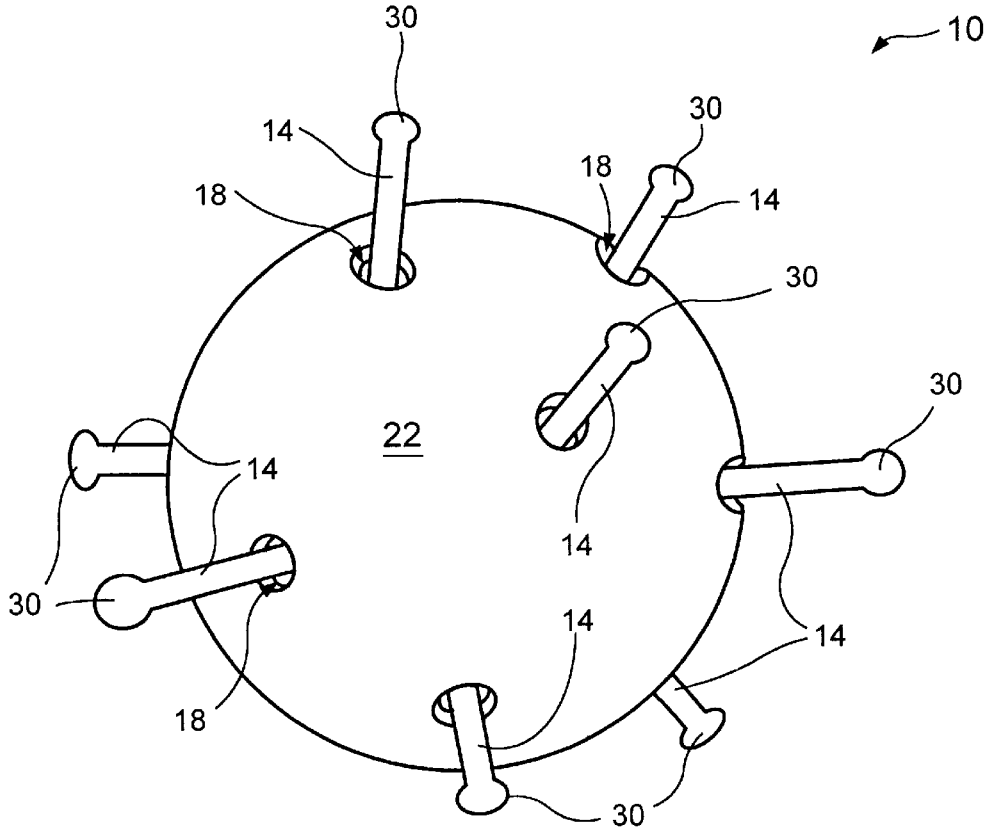
FIG. 2 is an orthographic view of the hand exercise device of FIG. 1.

Referring now to the drawings, and to FIGS. 1 and 2 in particular, a hand exercise device 10 according to a first embodiment of the invention comprises a housing 12, a plurality of exercise rods 14 extending out of the housing 12, and filler material 16 located within the housing and surrounding the rods 14.

The housing is preferably molded into a substantially hollow shape and is sized to fit comfortably in the hand of a user. An exterior of the housing can be formed having a spherical configuration. A plurality of apertures 18 are formed in a wall 20 of the housing between an outer surface 22 and an inner surface 24. Although any number of apertures may be formed at any location in the wall 20, twelve apertures are preferably formed at discreet intervals around the housing, with each aperture defining a corner of an icosahedron. The housing may be constructed of a relatively hard, transparent plastic material that is resistant to deformation from forces applied by a user's hand. It is to be understood, of course, that the housing may be formed of any suitable material, whether transparent, translucent or opaque, and may be formed into any desired shape. Any number and location of the apertures are contemplated.

An exercise rod 14 extends through each aperture 18 and into the interior 26 of the housing 12. Each rod 14 includes an elongate center section 28 that is preferably substantially constant in cross section, with an inner ball section 29 connected at an inner end of the center section 28 within the housing 12, and an outer ball section 30 connected at an outer end of the center section outside of the housing. Preferably, the center section 28 and ball sections 29 and 30 are integrally formed of a plastic material during molding. Alternatively, the center and ball sections may be formed separately and connected together through cooperating threads, adhesives, fasteners, or other well known fastening means. It is to be understood, of course, that any other suitable material may be used to form the exercise rod 14. Each ball section 29, 30 is preferably greater in diameter than the apertures 18 in the housing 12 in order to facilitate engagement with fingers of a user and to prevent the rods from being separated from the housing during use and/or to prevent complete penetration of the rods into the interior of the housing.

The filler material 16 comprises a plurality of particles 32 that may be constructed of plastic, rubber or other elastomeric material, metal, sand, ceramic, rock, or the like, or any combination thereof, and may be uniform or irregular in shape. Each particle 32 frictionally engages surrounding particles and the rods 14. Although the particles are preferably constructed of crush-resistant material, deformable, elastomeric-type material may additionally or alternatively be used. The size of each particle 32 is greater than a maximum distance between the center section 28 of the rod 14 and its associated aperture 18 when the rod slides within the aperture. In this manner, the particles are contained within the housing 12.

In use, all of the rods 14 are at an initially extended position wherein the inner ball sections 29 are situated in the vicinity of the inner surface 24 of the wall 20. A user then grasps the device 10 in one hand and selectively moves one or more fingers on either hand into contact with the outer ball section 30 of a selected rod. Each rod 14 is then pressed into the housing 12 until a final retracted position is reached wherein the outer ball section 30 abuts the outer surface 22 of the wall 20. The particles 32 frictionally engage each other, the inner ball section 29 and the rod 14 to create resistance during movement of the rod. The amount of resistance can be adjusted by varying the size and shape of the particles and the rod assembly, as well as choosing a material that has a desired coefficient of friction. Once the rods are pressed into the housing 12, they may be withdrawn to their initial extended positions to repeat the exercise.

Figure 3:
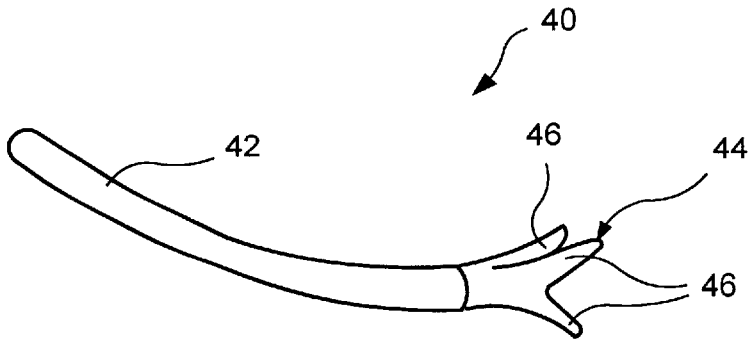
FIG. 3 is a side elevational view of an exercise rod according to a second rod embodiment for use in the hand exercise device of FIG. 1.

With reference now to FIG. 3, an exercise rod 40 according to a second rod embodiment of the invention is illustrated. The rod 40 in this embodiment includes a substantially cylindrical body section 42 constructed of a flexible material, and a head section 44 connected to or integrally formed with the body section. The head section 44 includes three arms 46 that extend generally outwardly and away from the body 42. The distance between the outer free ends of adjacent arms 46 is preferably greater than the cross dimensions of the apertures 18. Therefore, the exercise rod 40 cannot be separated from the housing 12 when the head section 44 is located within the interior 26 of the housing and the body section 42 extends through one of the apertures. As in the previous embodiment, the diameter of the body section 42 is chosen such that a maximum distance between the body section and its associated aperture, while the rod slides within the aperture, is less than the particle size, so that the particles remain in the housing 12. The exercise rods 40 may be exclusively installed in all of the apertures 18 of the housing 12, or may be installed in some of the apertures while exercise rods 14 are installed in the remaining apertures.

Figure 4:
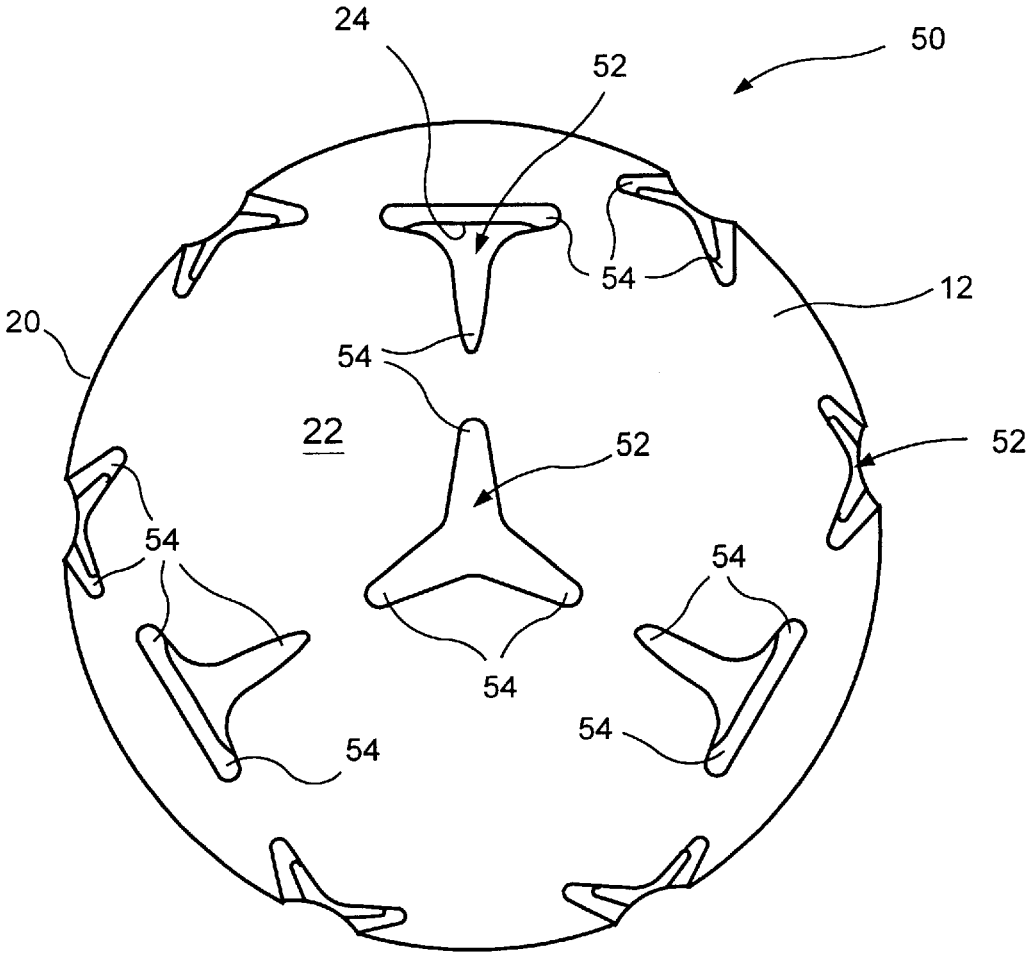
FIG. 4 is an orthographic view of a housing of a hand exercise device according to a second embodiment of the invention.
Figure 7:
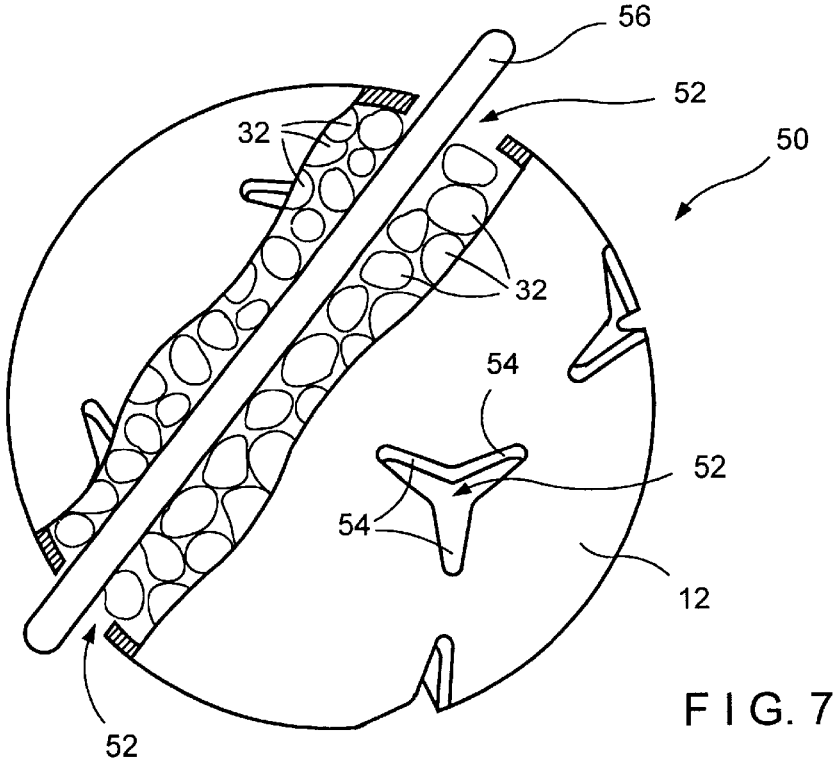
FIG. 7 is a front elevational view in partial cross section of the hand exercise device of FIG. 4.

With reference now to FIGS. 4 and 7, an exercise device 50 according to a second embodiment of the invention is illustrated, wherein like parts in the previous embodiment are represented by like numerals. The exercise device 50 includes a hollow, substantially spherical housing 12 and an exercise rod 56 passing through openings 52 formed in the housing. The openings 52 extend through the wall 20 from the outer surface 22 to the inner surface 24 thereof. Preferably, twenty openings 52 are provided, with a center of each opening coinciding with a corner of an imaginary dodecahedron on the housing 12. Each opening includes three rays 54 that are oriented along the edges of the imaginary dodecahedron.

Figure 5:
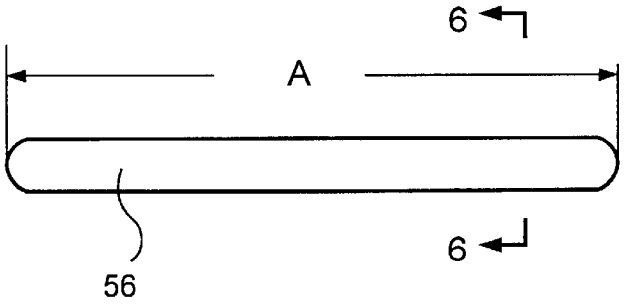
FIG. 5 is a side elevational view of an exercise rod for use in the embodiment of FIG. 4.
Figure 6:
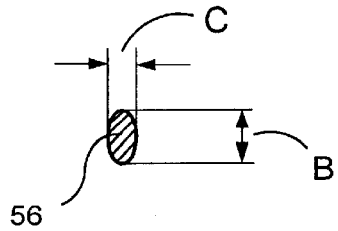
FIG. 6 is a cross sectional view of the exercise rod taken along line 6—6 of FIG. 5.

As shown in FIGS. 5 and 6, the exercise rod 56 is substantially uniform in cross section along its axial length. Preferably, the cross sectional shape of the rod 56 is oval, although other cross sectional shapes are contemplated. The rod 56 preferably has a length "A" that is greater than the diameter of the housing 12, a width "B" that is smaller than a length of each ray 54, and a thickness "C" that is smaller than the width of each ray. In this manner, the rod 56 can extend entirely through the housing 12 by way of openings 52 and can be selectively inserted into each ray of one or both openings through which the rod extends. Different angular orientations of the rod 56 with respect to the housing 12 can be obtained by removing the rod from one or both openings and insertion the rod into one or more different openings.

In addition to the benefits derived from using the exercise device 50, such as increased strength and mobility in the hand and fingers, motivation to exercise may be enhanced byr intellectual stimulation, wherein a user determines which rods must be inserted into which pairs of openings and in which order the rods (ten in the present embodiment) should be inserted through different pairs of openings in the housing 12 without interference from other rods.

Figure 8:
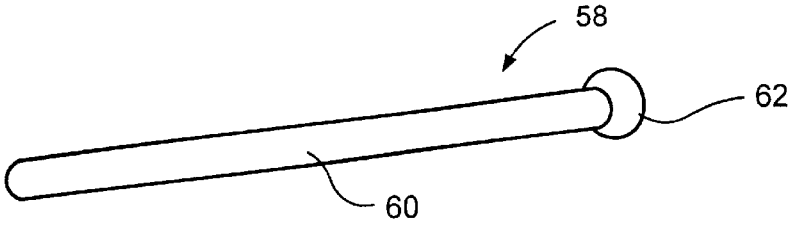
FIG. 8 is a perspective view of an exercise rod according to a third rod embodiment for use with the hand exercise device of FIG. 7.

With further reference to FIG. 8, an alternative embodiment of an exercise rod 58 for use with the FIGS. 4 and 7 embodiment is illustrated. The exercise rod 58 includes a bar 60 that is similar in cross section to the rod 56, and a ball section 62 that is connected to or integrally formed with an end of the bar 62. Preferably, the ball section 58 is greater in diameter than the openings 52 in the housing 12 in order to prevent the rods 58 from being separated from the housing during use and/or to prevent complete penetration of the rods into the interior of the housing.

Figure 9:
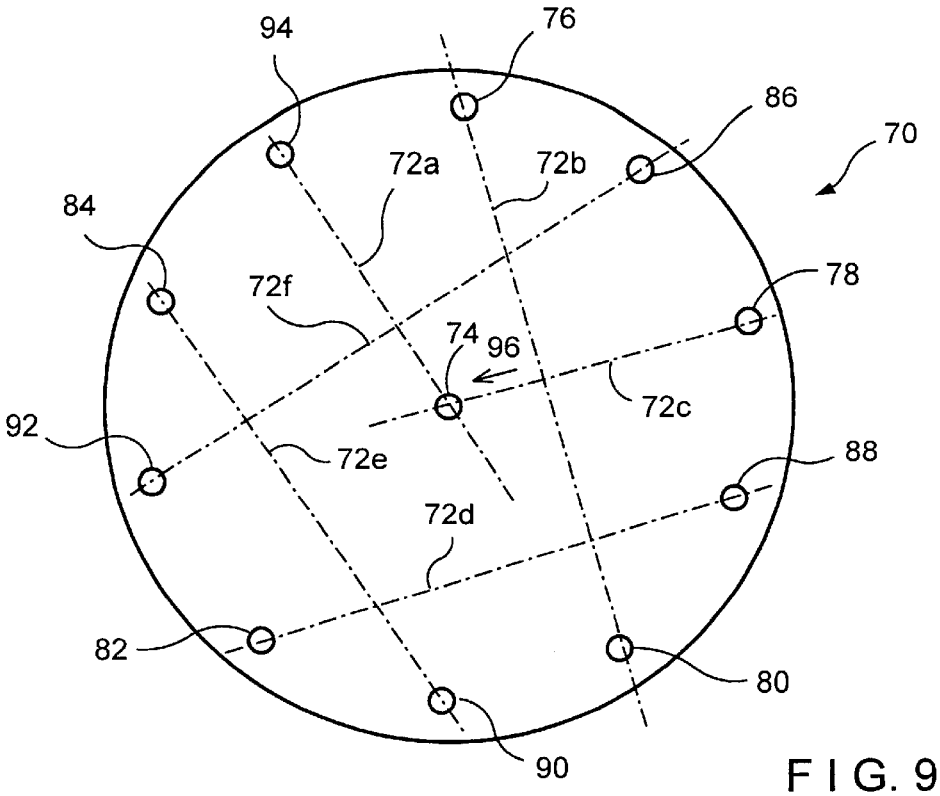
FIG. 9 is a top plan view of a hand exercise device according to a third embodiment of the invention.

As shown schematically in FIG. 9, a top plan view of an exercise device 70 according to a third embodiment of the invention is illustrated, wherein like parts in the previous embodiments are represented by like numerals. As in the previous embodiments, the exercise device 70 includes a hollow, substantially spherical housing 12 and exercise rods 72*a* to 72*f* (shown in phantom line) passing through apertures 74 to 96, respectively, with apertures 86, 88, 90, 92, and 94 shown in hidden line, formed in the housing. In this embodiment, the centers of the twelve apertures coincide with the corners of an imaginary icosahedron formed within the spherical housing 12. As shown, apertures 74 to 84 are located in an upper hemisphere of the housing 12, while apertures 86 to 96 are located in a lower hemisphere of the housing. The exercise rods 72*a* to 72*f* extend through different pairs of apertures. By way, of example, rod 72*a* may extend through apertures 74 and 94, rod 72*b* may extend through apertures 76 and 80, rod 72*c* may extend through apertures 78 and 96, rod 72*d* may extend through apertures 82 and 88, rod 72*e* may extend through apertures 84 and 90, and rod 72*f* may extend through apertures 86 and 92. It should be understood that any reasonable number and location of the apertures are within the scope of the invention.

Figure 10:
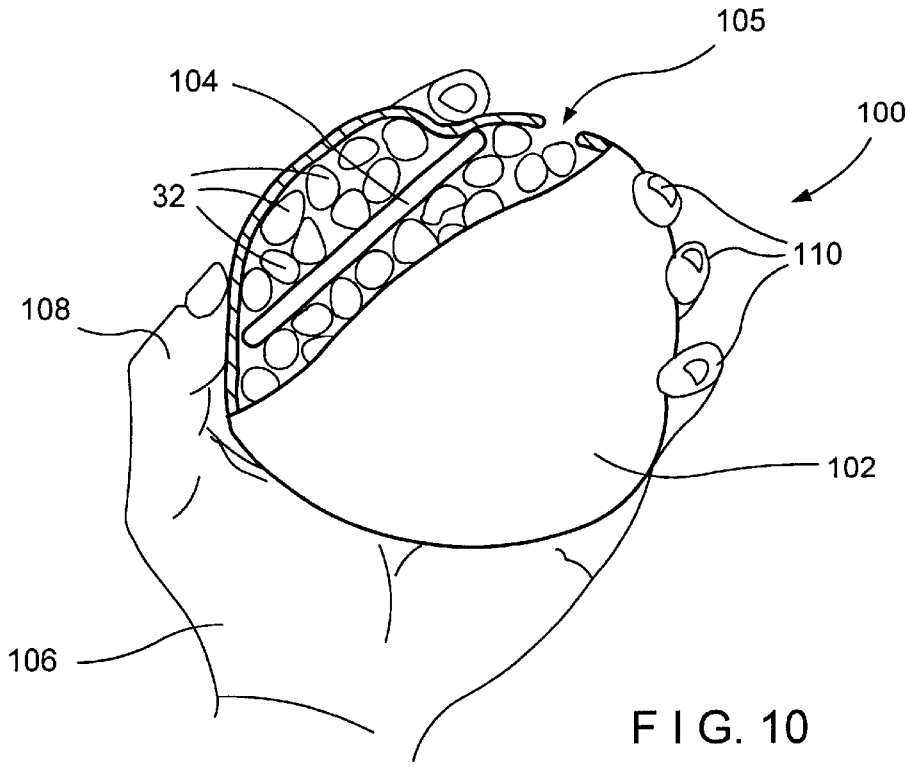
FIG. 10 shows in partial cross section a hand exercise device according to a fourth embodiment of the invention positioned in the hand of a user.
Figure 11:
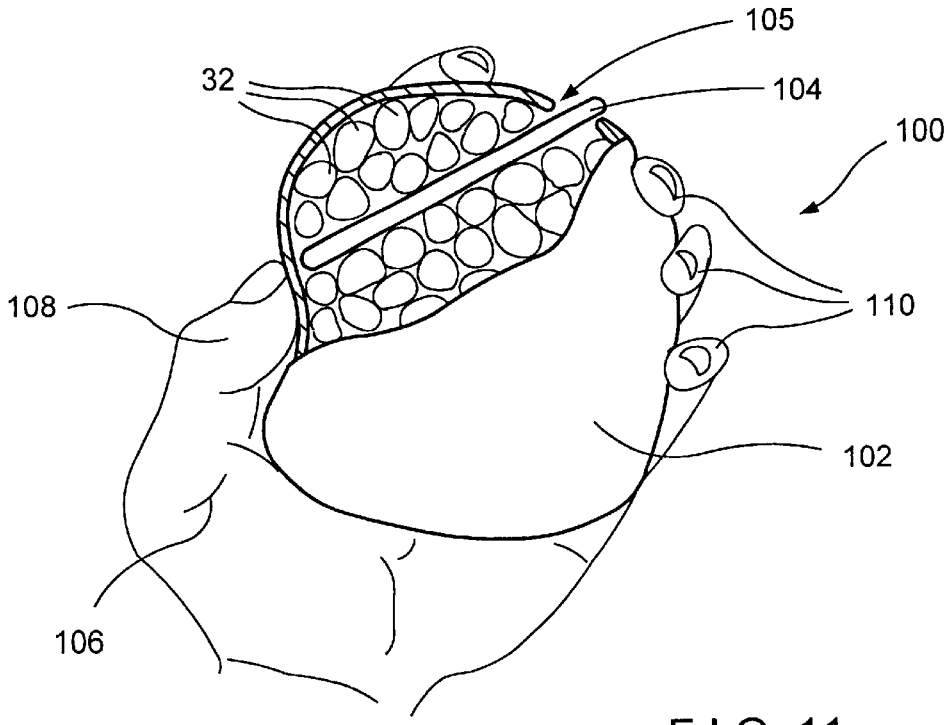
FIG. 11 is similar to FIG. 10 and shows deformation of the hand exercise device during use.

With reference now to FIGS. 10 and 11, a hand exercise device 100 according to a fourth embodiment of the invention is illustrated, wherein like parts in the previous embodiments are represented by like numerals. The exercise device 100 includes a hollow housing 102 that is constructed of a soft, flexible or resilient material and an exercise rod 104 initially completely embedded in the particles 32 within the housing. The housing includes an aperture 105 that is smaller than the smallest cross section of the particles 32, but larger than the diameter of the exercise rod 104. The exercise rod 104 is preferably cylindrical and has a length that is smaller than the cross dimension of the housing 102.

In use, the exercise device 100 can be grasped by the hand 106 of a user between the thumb 108 and fingers 110, as shown in FIG. 10. By squeezing the housing 102, the user is able to push the concealed exercise rod 104 out of the housing through the aperture 108 (FIG. 11) against friction caused by the mutual engagement of the rod 104 and particles 32. The rod 104 can then be pushed back into concealment within the housing 102. In this manner, the user not only exercises the fingers and thumb by squeezing the housing 102, but also by pushing the rod back into the housing. Although only one aperture and rod are shown, it is to be understood that a plurality of apertures and/or rods can be provided.

Figure 12:
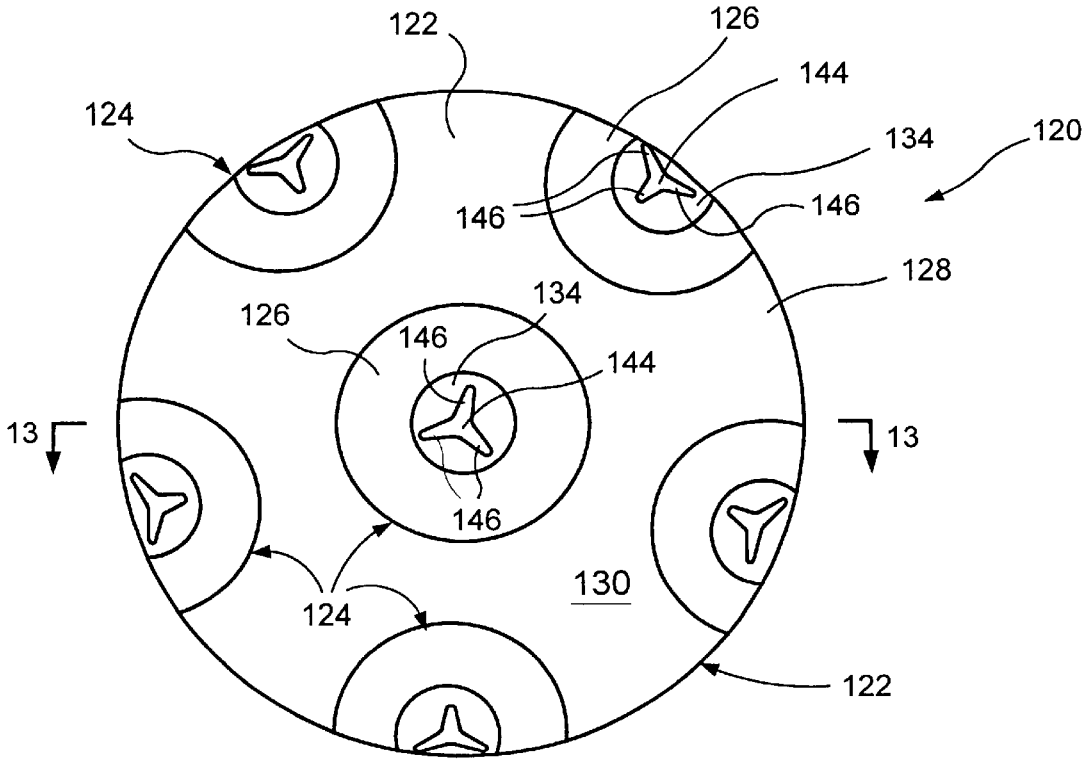
FIG. 12 is a top plan view of a hand exercise device according to a fifth embodiment of the invention.
Figure 13:
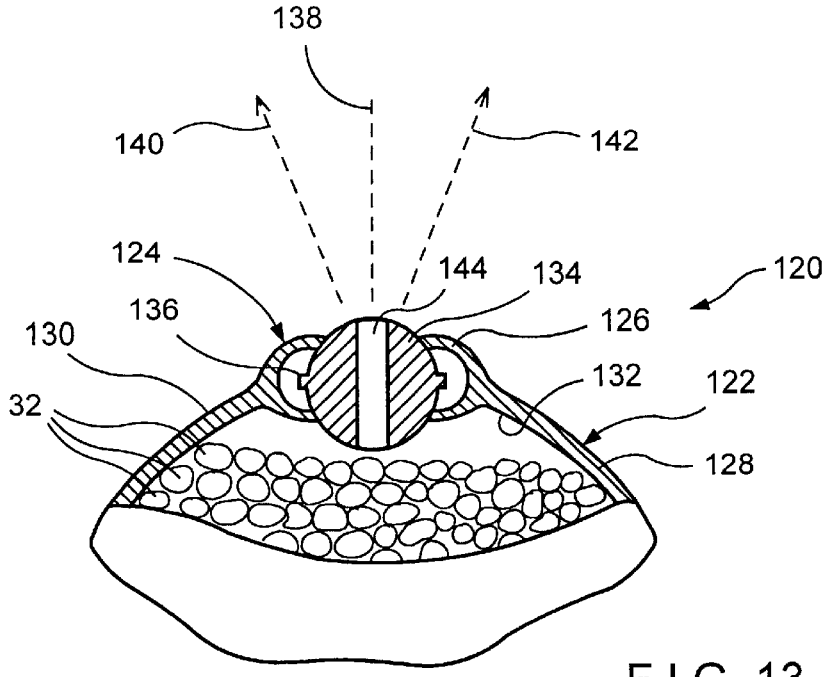
FIG. 13 is a cross sectional view taken along line 13—13 of FIG. 12 and illustrating a ball and socket joint of the hand exercise device according to the fifth embodiment.

As shown in FIGS. 12 and 13, a hand exercise device 120 according to a fifth embodiment of the invention is illustrated, wherein like parts in the previous embodiments are represented by like numerals. The exercise device 120 includes a hollow, substantially spherical housing 122 with a plurality of ball and socket joints 124 and an exercise rod 127 (FIG. 14) adapted for slidable mounting in each joint. Each ball and socket joint 124 includes an annular socket 126 formed in a wall 128 of the housing between an outer surface 130 and an inner surface 132 of the wall. A ball 134 is mounted for rotation in the socket 126. An annular rib 136 is formed around the circumference of the ball and serves to limit the amount of ball's rotation about two perpendicular axes, while allowing free rotation about a third axis 138 perpendicular to the first two axes. The amount of permitted rotation between the ball 134 and socket 126 in one plane is represented by arrows 140 and 142 in FIG. 13. A bore 144 extends through the ball 134 and includes three rays 146 that are sized to receive the exercise rod 127.

Figure 14:
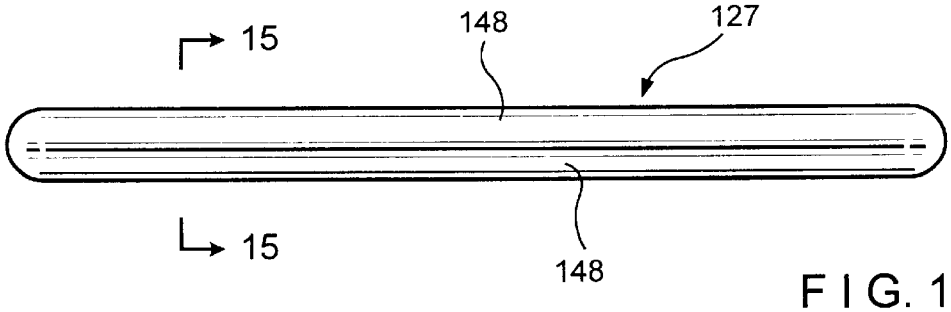
FIG. 14 is a side elevational view of an exercise rod according to a fourth rod embodiment.
Figure 15:
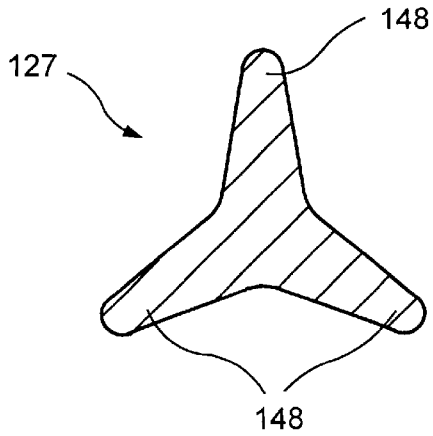
FIG. 15 is a cross sectional view of the exercise rod fourth embodiment taken along line 15—15 of FIG. 14.

With additional reference to FIGS. 14 and 15, the exercise rod 127 comprises three ribs 148 that extend along the length of the rod. The ribs 148 are sized to be slidably received in the three rays 146 of the bore 144. Preferably, the ribs and rays are located at 120 degree intervals about a central axis of the rod and bore, respectively.

With the above-described arrangement, each rod can be tilted and slid with respect to the housing 122 during exercise. The ball and socket joint 124 permits a smaller bore size than the embodiments as depicted in FIGS. 1, 2 and FIGS. 4 to 7. Accordingly, smaller particles 32 can be located within the housing 122.

Figure 16:
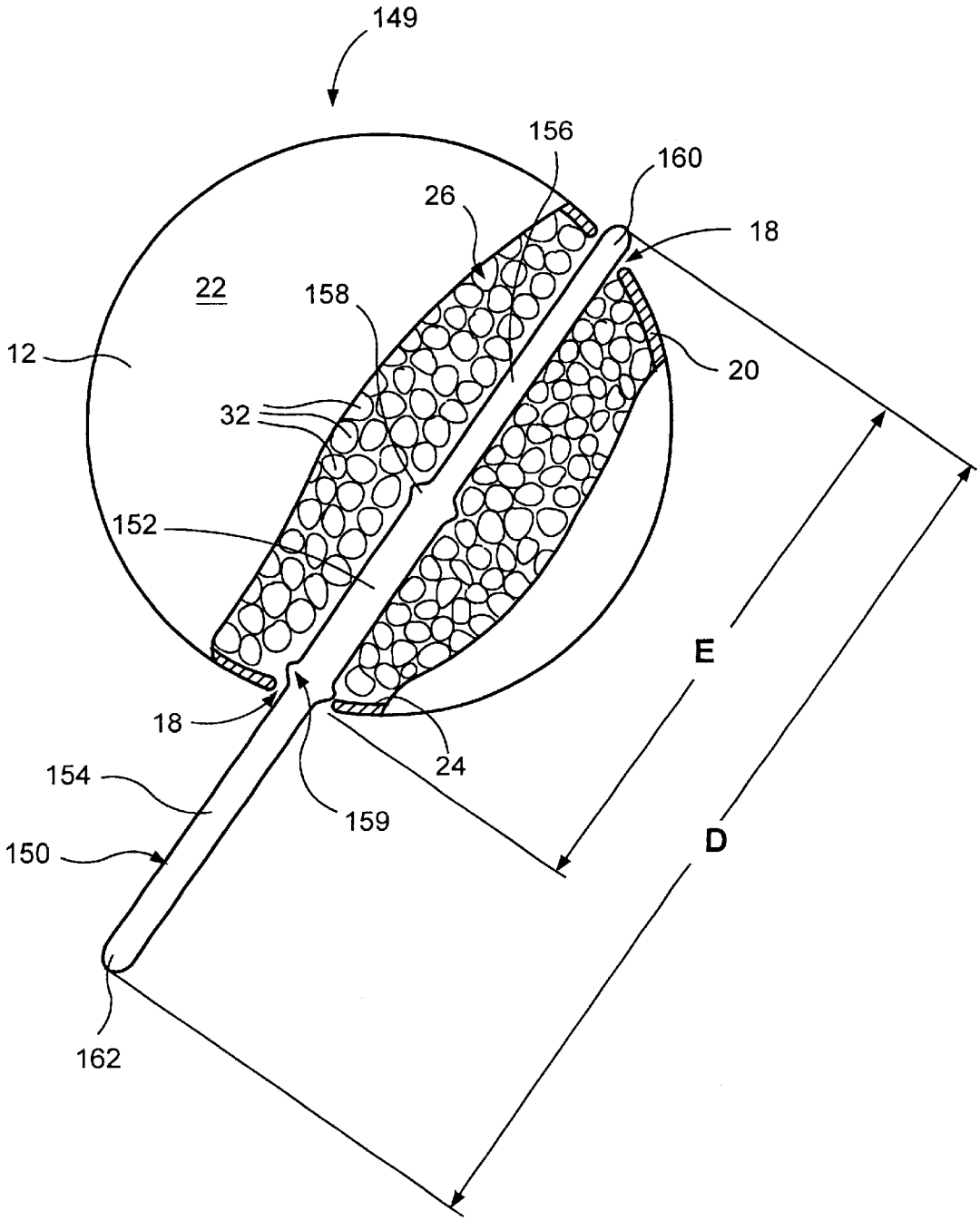
FIG. 16 is a side elevational view, in partial cross section, of a hand exercise device and showing an exercise rod according to a fifth rod embodiment mounted in a housing of the hand exercise device.

Turning now to FIG. 16, an exercise device 149 employing an exercise rod 150 according to a fifth rod embodiment is shown, wherein like parts in the previous embodiments are represented by like numerals. For clarity, only one exercise rod 150 will be described in conjunction with the housing 12 and particles 32 of the FIG. 1 embodiment. It is to be understood, however, that the cross sectional shape of the rod 150 can be modified to accommodate any of the previous housing embodiments, and that more than one exercise rod 150 may be associated with such embodiments.

The exercise rod 150 is preferably formed of a relatively stiff material and extends through each aperture 18. The rod 150 includes an elongate center section 152 and two elongate end sections 154, 156 extending in opposite directions from the center section 152. Preferably, the center section and end sections extend along a common central axis, with the end sections being equal in length. The center section 152 is larger in diameter than the end sections 154, 156 and the apertures 18 so as to prevent separation of the rod 150 from the housing 12. Rounded flanges 158 and 159 are formed at opposite ends of the center section 152. The flanges provide increased contact area with the particles 32 and therefore increase resistance to movement of the rod 150 through the particles.

In an alternative embodiment, the larger diameter center section 152 can be replaced with outer larger diameter sections located at opposite ends of the rod 150 outside of the housing in order to prevent separation of the rod from the housing. Moreover, although the center section is shown as cylindrical in shape, the center section may be spherical oval, and so on. In an alternative arrangement, the rod 150 may be formed of a flexible material.

The length "D" of the rod 150 is preferably greater than a distance "E" between two apertures 18 through which the rod extends, but less than twice the distance "E." In this manner, an outer free end 160 of the end section 156 is substantially flush with the outer wall surface 22 when the flange 159 abuts the inner wall surface 24. Likewise, an outer free end 162 of the end section 154 is substantially flush with the outer wall surface 22 when the flange 158 abuts the inner wall surface 24. The outer free end 162 may have a different color than the outer free end 160, such as red and blue, so as to distinguish between which ends need to be pushed by a user toward the housing 12.

Figure 17:
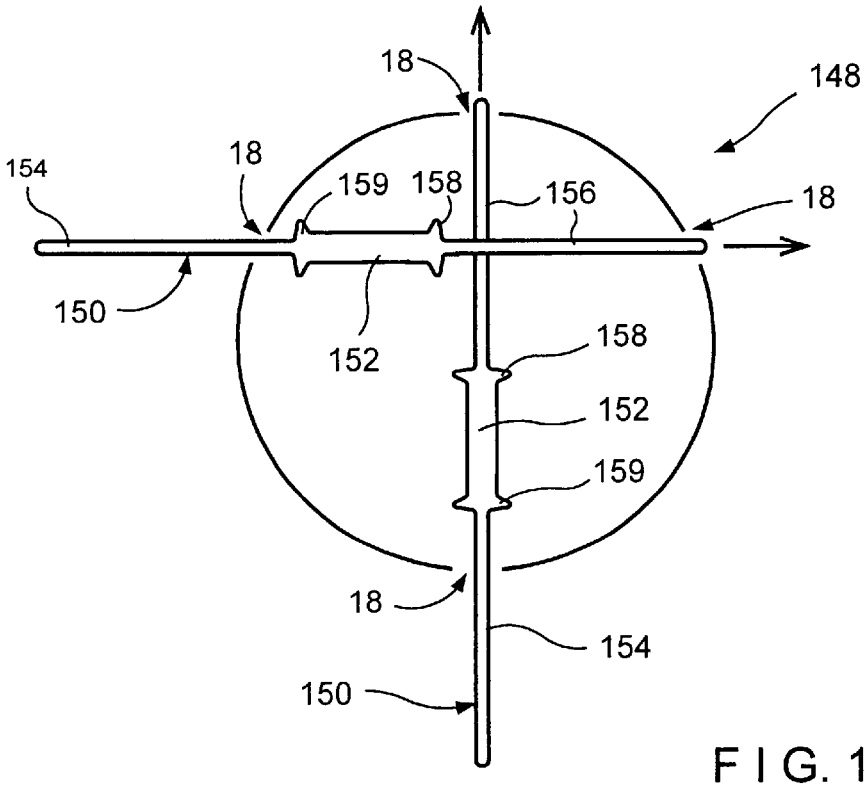
FIG. 17 is a side elevational schematic representation of the hand exercise device of FIG. 16 with two exercise rods mounted in the housing.
Figure 18:
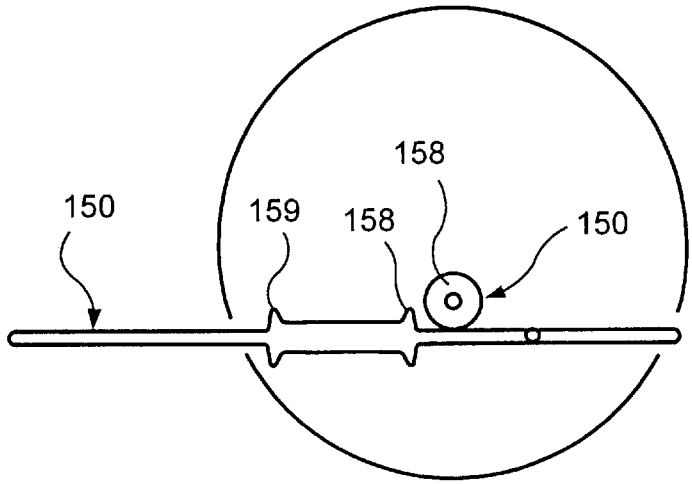
FIG. 18 is a top plan schematic representation of the hand exercise device of FIG. 16 and illustrating the relationship between the two exercise rods.

In addition to exercising the hands and/or fingers, the exercise device 149 can be used as an intellectual stimulant, as shown schematically in FIGS. 17 and 18. As shown, two rods 150 are oriented substantially perpendicular to each other. When pushing the rods 150 toward the housing 12, a user must take into consideration the relative placement and orientation of the center sections 152 in order to avoid interference between the center sections during movement. Greater difficulty can be achieved by adding more rods 150.

It is to be understood that the various features of the previously described embodiments can be combined to form unique structures. For example, two or more different types of rods may be combined with a single housing in order to achieve different exercise effects.

Figure 19:
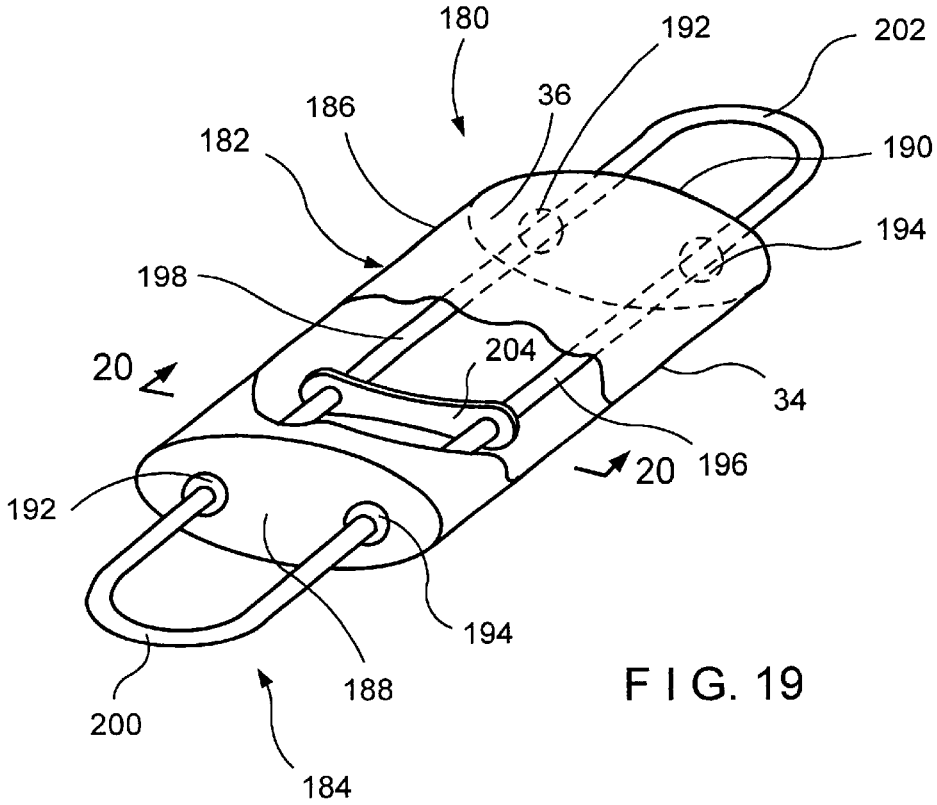
FIG. 19 is an orthographic, partially broken view of a hand exercise device according to a sixth embodiment of the invention.
Figure 20:
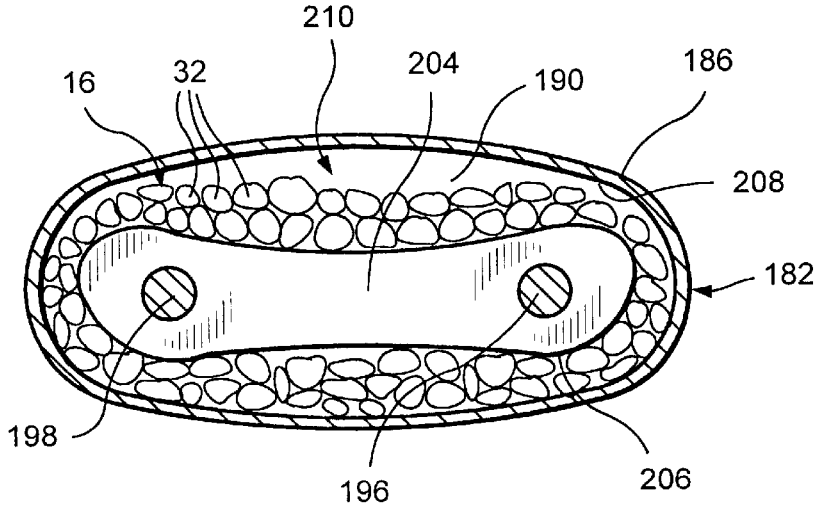
FIG. 20 is a cross sectional view of the hand exercise device taken along line 20—20 of FIG. 19.

With reference now to FIGS. 19 and 20, a hand exercise device 180 according to a sixth embodiment of the invention is illustrated, wherein like parts in the previous embodiments are represented by like numerals. The hand exercise device 180 comprises a housing 182, an exercise rod assembly 184 extending out of the housing 182, and filler material 16 comprising particles 32 located within the housing and surrounding the rod assembly 184.

The housing 182 includes a continuous side wall 186 that is preferably oval in cross section, with a front wall 188 and a rear wall 190 provided at opposite ends of the side wall. In an alternative embodiment of the invention, at least one of the walls may be integrally molded to the side wall, while the other wall is attached to the side wall through adhesives, ultrasonic welding, snapfit, or other well known means of attachment. Spaced apertures 192 and 194 are formed in the front and rear walls. As in the previous embodiments, the housing may be constructed of a relatively hard, transparent plastic material that is resistant to deformation from forces applied by a user's hand. It is to be understood, of course, that the housing may be formed of any suitable material, whether transparent, translucent or opaque, and may be formed into any desired shape.

The exercise rod assembly 184 has a first piston rod 196 connected to a second piston rod 198 at a front rod section 200 and a rear rod section 202. Preferably, the front and rear rod sections are curved. A piston head 204 extends between and is rigidly connected to the first and second piston rods. The piston head 204 is preferably constructed of a flat plate material. A peripheral edge 206 of the piston head 204 is spaced from an inner surface 208 of the side wall 186 to form a gap 210 through which the particles 32 may flow when the piston head is moved within the housing 182. The interior of the housing is not completely filled by the particles 32.

Figure 21C:
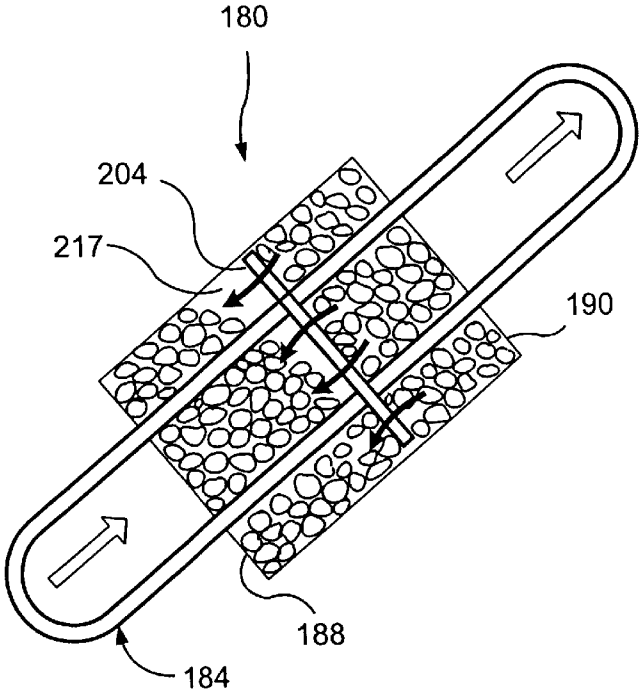
FIGS. 21A to 21C illustrate a top cross sectional view of the hand exercise device of FIG. 19 with an exercise rod assembly in first, second, and third positions, respectively.
Figure 21A:
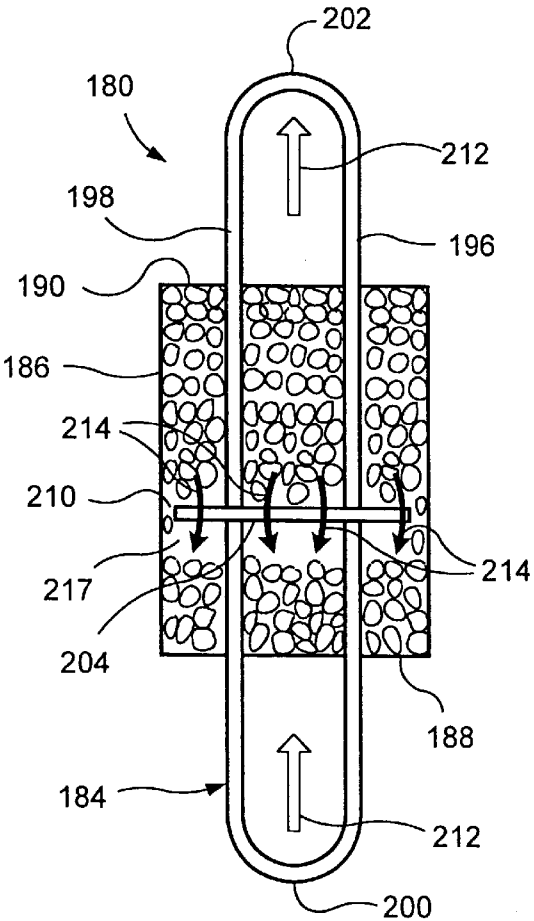
Figure 21B:
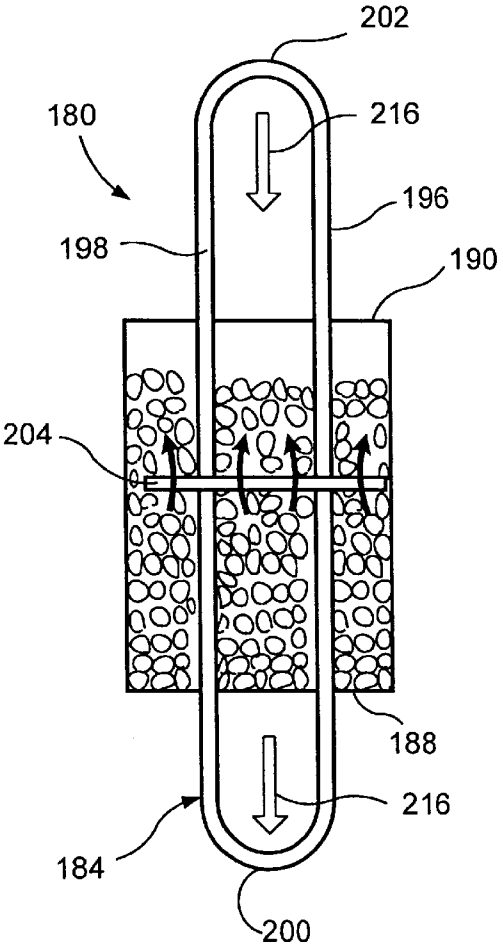
Figure 22:
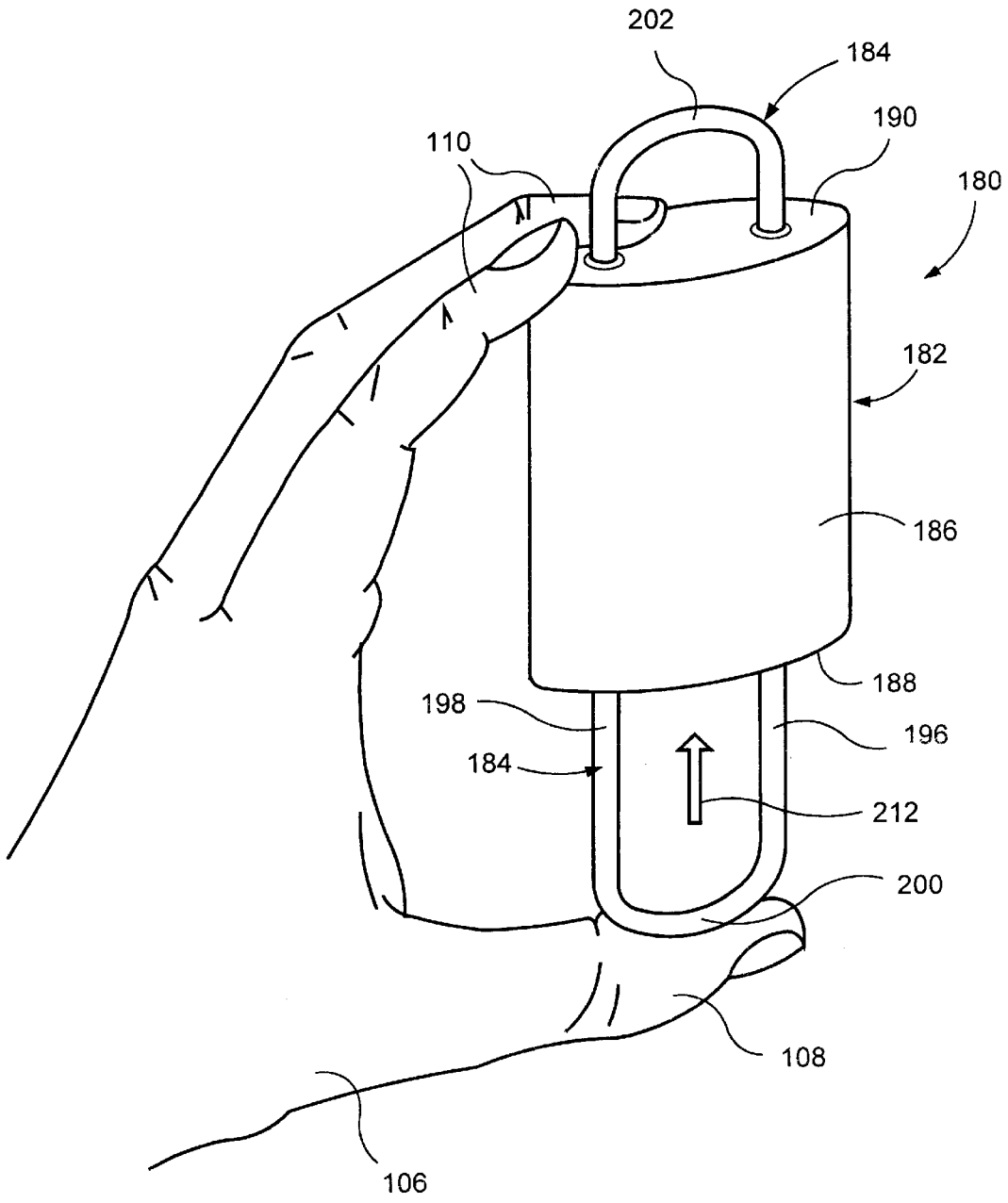
FIG. 22 illustrates the hand exercise device of FIG. 19 in the hand of a user during use.

By way of example, and with further reference to FIGS. 21A to 21C and 22, the exercise device 180 is operated by positioning one or more of the fingers 110 of a users hand on the rear wall 190 of the housing 182 while the thumb 108 is positioned on the front rod section 200 of the rod assembly 184. The fingers and thumb are then moved toward each other in order to move the rod assembly 184 with respect to the housing 182 in a direction as represented by arrow 212. As shown in FIG. 21A, this movement causes the particles 32 to flow through the gap 210 between the piston head 204 and the side wall 186 in a direction as represented by arrows 214. The size, number, and coefficient of friction of the particles contribute to resisting movement in the applied direction. Once the desired amount of movement is achieved, the position of the fingers and thumb may be reversed to move the rod assembly in the opposite direction as represented by arrows 216 (FIG. 21B). Instead of using the thumb and fingers for controlling movement of the rod assembly, areas of the hand, such as the palm, in combination with the thumb or one or more fingers can be used, depending on the type of exercise desired. In addition, the exercise device 180 may be held in one hand while the rod assembly is grasped by the other hand and moved toward and away from the one hand to thereby exercise the muscles associated with the hand, wrist, and arms. It is also contemplated that the exercise device 180 may be adapted to exercise the muscles associated with the feet or other appendages.

It should be noted that movement of the rod assembly 184 in one direction requires substantially less force than movement in the opposite direction. When the rod assembly is moved in the direction shown in FIG. 21A, the particles 32 are transferred from an area above the piston head 204 to an empty area 217 therebelow relatively freely under the force of gravity. When the rod assembly is moved in the opposite direction as shown in FIG. 21B, there is no free movement of the particles 32 since there is no longer the empty area 217 adjacent the piston head that is void of the particles. The particles 32 must therefore be forced from an area under the piston head to an area above the piston head. By changing the orientation of the exercise device 180, the user can select appropriate resistance forces for both directions of movement of the rod assembly. For example, when the exercise device 180 is oriented in a position as shown in FIG. 21C, the resistance forces are greater than the force associated with FIG. 21A and less than the force associated with FIG. 21B. It should be realized that the exercise device with any reasonable number of rods and corresponding apertures is within the scope of the invention.

While the invention has been taught with specific reference to the above-described embodiments, those skilled in the art will recognize that changes can be made in form and detail without departing from the spirit and the scope of the invention. Thus, the described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The embodiments for which an exclusive property or privilege is claimed are defined as follows:

1. An exercise device, comprising:

a housing having at least one wall portion defining a hollow interior;

at least one aperture extending through the wall portion;

at least one elongate rod having opposite ends and a center section located between the opposite ends, the center section being normally located within the hollow interior and being adapted for slidable movement through the at least one aperture; and filler material located within the hollow interior, the filler material comprising a plurality of solid particles in frictional engagement with the elongate rod to thereby resist sliding movement of the rod through the at least one aperture.

2. An exercise device according to claim 1, wherein the housing is substantially of hollow spherical construction.

3. An exercise device according to claim 1, and further comprising an enlarged section formed at one end of the at least one rod, the enlarged section having a cross dimension that is larger than a cross dimension of the at least one aperture to thereby prevent separation of the rod from the housing.

4. An exercise device according to claim 1, and further comprising an enlarged section formed at each end of the at least one rod, each enlarged section having a cross dimension that is larger than a cross dimension of the at least one aperture to thereby prevent separation of the rod from the housing.

5. An exercise device according to claim 1, wherein the at least one aperture comprises a plurality of apertures positioned at predetermined locations on the housing; and further wherein the at least one rod comprises a plurality of rods with the center section of each rod being normally located within the housing interior and being adapted for slidable movement through at least one of the apertures.

6. An exercise device according to claim 5, wherein a length of at least one of the rods is longer than a distance between at least two of the apertures such that the opposite ends of the at least one rod normally extends through the at least two apertures.

7. An exercise device according to claim 6, wherein the center section of the at least one rod includes an area with a cross dimension that is larger than a cross dimension of the at least two apertures to thereby prevent separation of the at least one rod from the housing.

8. An exercise device according to claim 5, wherein a center of each aperture is positioned on a corner of an imaginary icosahedron inscribed on the hollow, spherical housing.

9. An exercise device according to claim 8, wherein each aperture includes multiple rays.

10. An exercise device according to claim 5, wherein a center of each aperture is positioned on a corner of an imaginary dodecahedron inscribed on the hollow, spherical housing.

11. An exercise device according to claim 1, wherein the housing is constructed of a resilient material.

12. An exercise device according to claim 2, wherein the housing is constructed of a relatively hard material that is resistant to the deformation from forces applied by a user's hand.

13. An exercise device according to claim 1, wherein the at least one wall portion includes a front end portion, a rear end portion spaced from the front end portion, and a continuous wall portion extending between, and connected to the front and rear end portions to thereby form the hollow interior.

14. An exercise device according to claim 13, wherein the at least one aperture comprises apertures extending through each of the front and rear end portions; and further wherein the at least one rod extending through the apertures of the front and rear end portions and a piston head connected to the at least one rod situated within the interior of the housing.

15. An exercise device according to claim 13, wherein the at least one aperture comprises first and second spaced apertures extending through each of the front and rear end portions; and further wherein the at least one rod comprises a first rod extending through the first apertures of the front and rear end portions and a second rod extending through the second apertures of the front and rear portions; at least one end of the first rod is connected to at least one end of the second rod.

16. An exercise device according to claim 15, and further comprising a piston head located within the hollow interior, the piston head extending between, and being rigidly connected to the center sections of the first and second rods.

17. An exercise device according to claim 1, and further comprising a socket formed in the housing and a ball positioned in the socket for rotation, with the aperture extending through the ball for rotation therewith.

18. An exercise device according to claim 17, wherein the ball includes an annular rib that engages the socket to thereby limit the amount of ball rotation within the socket.

* * * * *